US009829236B2

(12) United States Patent
Yun

(10) Patent No.: US 9,829,236 B2
(45) Date of Patent: Nov. 28, 2017

(54) REFRIGERATOR CAPABLE OF MAKING ICE PARTICLES AND METHOD FOR MAKING ICE PARTICLES

(71) Applicant: Dongbu Daewoo Electronics Corporation, Seoul (KR)

(72) Inventor: Young Hyun Yun, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 133 days.

(21) Appl. No.: 14/836,831

(22) Filed: Aug. 26, 2015

(65) Prior Publication Data

US 2016/0370051 A1 Dec. 22, 2016

(30) Foreign Application Priority Data

Jun. 17, 2015 (KR) ..... 10-2015-0085953

(51) Int. Cl.
*F25C 1/00* (2006.01)
*F25C 5/00* (2006.01)
*F25D 23/12* (2006.01)

(52) U.S. Cl.
CPC ..... *F25C 5/005* (2013.01); *F25D 23/126* (2013.01); *F25C 1/00* (2013.01); *F25D 2400/02* (2013.01)

(58) Field of Classification Search
CPC ..... F25D 23/126; F25D 23/003; F25C 5/005
USPC ..... 62/74, 89, 186, 389, 416
See application file for complete search history.

(56) References Cited

U.S. PATENT DOCUMENTS

2009/0260370 A1* 10/2009 Wu ..... F25D 11/025 62/79
2012/0272670 A1* 11/2012 Choi ..... F25D 17/065 62/89

FOREIGN PATENT DOCUMENTS

JP 107-055307 A 3/1995
KR 10-2007-0034680 A 3/2007
KR 10-2012-0075731 A 7/2012

* cited by examiner

*Primary Examiner* — Melvin Jones

(57) ABSTRACT

A refrigerator includes a body having a storage space; a door coupled with the body and for opening/closing the storage space, and an ice particle maker equipped in the door, wherein the ice particle maker includes a water feed nozzle for injecting water supplied from a water supply source into an ice particle making area; a cold air flow path for supplying cold air to the ice particle making area; and a dispenser for discharging ice particles made from the ice particle maker.

14 Claims, 4 Drawing Sheets

REFRIGERATOR CAPABLE OF MAKING ICE PARTICLES AND METHOD FOR MAKING ICE PARTICLES

RELATED APPLICATION

This application claims priority to Korean Patent Application No. 10-2015-0085953, filed on Jun. 17, 2015, and hereby incorporated by reference in its entirety.

TECHNICAL FIELD

Embodiments according to the present invention relate to a refrigerator, and more particularly to a refrigerator capable of making ice particles and a method for making ice particles, through a process of ejecting supplied water through a water feed nozzle formed with a relatively narrow pipe having a predetermined diameter and rapidly cooling the water ejected from the water feed nozzle by injecting cold air into the water, so that the water freezes into relatively fine ice particles of, for example, a snow type.

BACKGROUND

In general, a refrigerator is an appliance with storage space for storing food at a reduced temperature, consisting of a refrigerator compartment maintaining a temperature a few degrees above the freezing point of water and a freezer compartment maintaining a temperature below the freezing point of water. Recent higher demand for ice contributes to increasing demand for a refrigerator equipped with an ice maker that automatically makes ice.

The ice maker may be installed in the freezer compartment depending on the type of a refrigerator, or in the refrigerator compartment if required.

FIG. 1 shows an example of an ice maker installed in the freezer compartment. The ice maker 100 has an ice storage unit 102 for storing ice as shown in FIG. 1, and the ice stored in the ice storage unit 102 may be dispensed to the outside through an ice dispenser unit in accordance with an external ice dispensing signal. In this case, if more ice than a prescribed amount of ice is dispensed to the outside, information is provided as feedback to enable the ice maker 100 to make ice again, and the ice may be introduced into the ice storage unit 102 again.

The ice maker 100 may be further equipped with an ice crushing device for crushing the ice into small pieces if required, and may crush and provide the ice made therein to address a user's request for ice flakes.

However, an additional mechanical device is required to crush or scrape the ice in order to crush the ice and provide ice flakes, contributing to increased installation cost and increased complexity of the ice maker structure. Also, crushing ice may not fully meet the demand for ice flakes of a snow type.

In addition, the ice crushing device composed of mechanical devices and rotational devices generates noise in the process of crushing or flaking ice, and also may experience lowered durability.

SUMMARY

In view of the above, embodiments according to the present invention provide a refrigerator capable of making ice particles and a method for making ice particles, through a process of ejecting supplied water through a water feed nozzle formed with a relatively narrow pipe having a predetermined diameter and rapidly cooling the water ejected from the water feed nozzle by injecting cold air into the water, and then freezing the water into relatively fine ice particles of, for example, a snow type.

In accordance with an embodiment of the present invention, a refrigerator includes: a body having a storage space; a door coupled with the body and for opening/closing the storage space, and an ice particle maker equipped in the door, wherein the ice particle maker includes a water feed nozzle for ejecting water supplied from a water supply source into an ice particle making area; a cold air flow path for supplying cold air to the ice particle making area; and a dispenser for discharging ice particles made from the ice particle maker.

Further, the refrigerator may include a heater for heating the water feed nozzle.

Further, the refrigerator may include a cold air supply unit installed in the outlet of the cold air flow path and for opening and closing the outlet adapted to the water supply or interruption.

Further, the water feed nozzle may have a diameter smaller than a feed pipe for supplying the water from the water supply source, in order to eject the water supplied from the feed pipe as particles of a predetermined size.

Further, the particles of a predetermined size may be sized to be rapidly frozen by the cold air into ice particles having a diameter not greater than a predetermined reference diameter.

Further, the water feed nozzle may be selected from a plurality of water feed nozzles that are individually connectable to the feed pipe, each of the water feed nozzles having a different diameter, where the selected water feed nozzle is then connected with the feed pipe.

Further, the water feed nozzle may include a diaphragm for changing the diameter of the water feed nozzle at the end of the water feed nozzle to control the size of water particles ejected by controlling the diaphragm.

Further, the heater may be installed at the end of the water feed nozzle, and is driven when the water is supplied or for a predetermined period of time before the water is supplied.

Further, the cold air supply unit may open the outlet of the cold air flow path when the water is supplied in order to inject the cold air into the water feed nozzle, and may close the outlet of the cold air flow path when the water supply is interrupted.

Further, the water feed nozzle may include a guide which is installed at the lower end thereof and is configured to gather the ice particles and drop them into a predetermined area, the guide having a diameter not greater than a predetermined reference diameter.

Further, the cold air flow path may include an ice particle fan installed at the rear end of the cold air flow path and configured to move the cold air supplied to the cold air flow path toward the outlet.

In accordance with an embodiment of the present invention, a method for making ice particles includes: controlling a water supply unit to supply water to a water feed nozzle connected with the water supply unit when a request for ice particles is received; controlling a cold air supply unit installed in the outlet of a cold air flow path to inject the cold air from the cold air path into the water feed nozzle when the water is being supplied from the water supply unit; and making ice particles by freezing the water ejected from the water feed nozzle into ice particles having a diameter not greater than a predetermined diameter.

Further, the method may include, in response to the request for a process of making ice particles, driving a heater installed at the water feed nozzle for a predetermined period of time before the water is supplied.

Further, the method may include, after performing the process of making ice particles, interrupting the water supply and controlling the cold air supply unit to close the outlet of the cold air flow path.

Therefore, a refrigerator in accordance with an embodiment of the present is capable of making and providing relatively fine ice particles of, for example, a snow type, through a process of ejecting supplied water through a water feed nozzle formed with a relatively narrow pipe with a predetermined diameter and rapidly cooling the water ejected from the water feed nozzle by injecting cold air into the water. In addition, it is not necessary to use expensive and complex equipment, for example, an ice crushing device to make fine ice particles; therefore, costs are saved, durability is enhanced, and noise is reduced.

DETAILED DESCRIPTION

Hereinafter, operating principles of the present invention will be described in detail with reference to the accompanying drawings. In the following description, well-known functions and/or structures will not be described in detail if they would unnecessarily obscure the features of the present invention. Further, the terms to be described below are defined in consideration of their functions in the embodiments of the present invention and may vary depending on a user's or operator's intention or practice.

Figure 1:
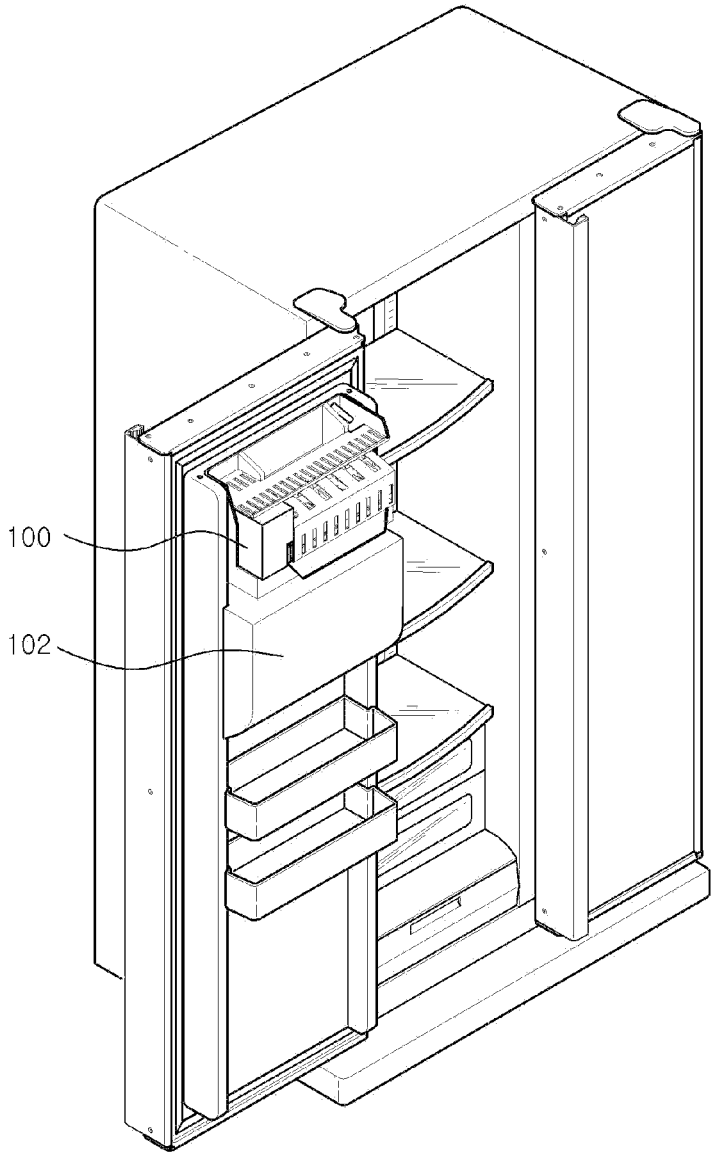
FIG. 1 (RELATED ART)
FIG. 1 shows an example ice maker installed in a freezer compartment of a refrigerator.
Figure 2:
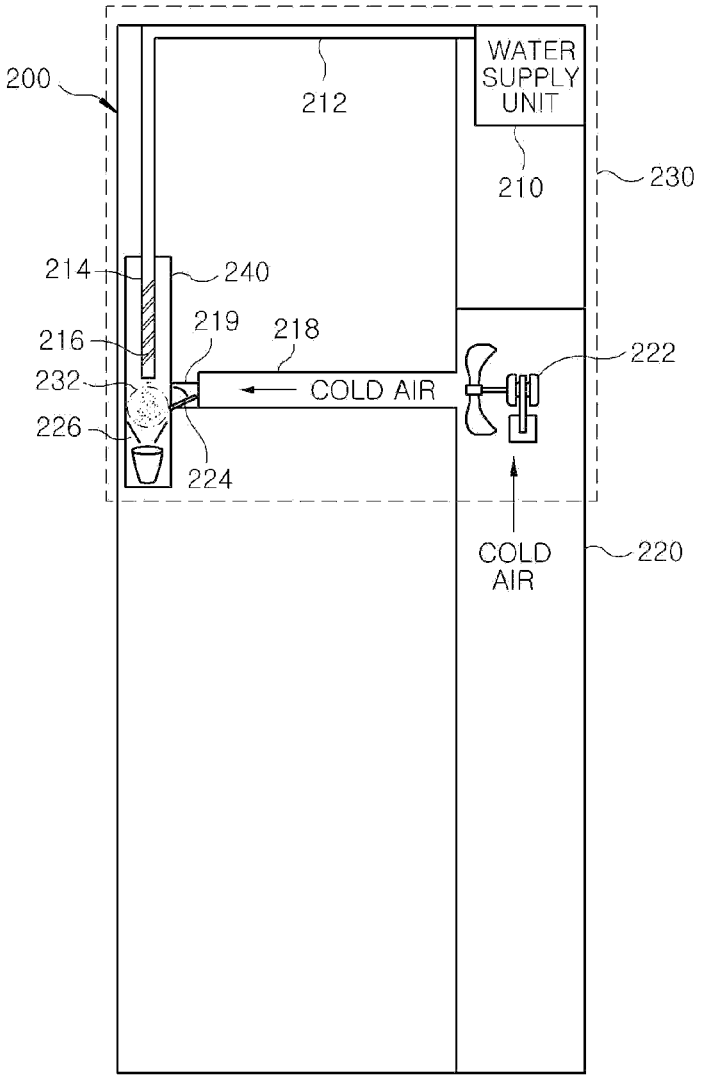
FIG. 2 shows an example refrigerator capable of making ice particles in accordance with an embodiment of the present invention.

FIG. 2 shows an example refrigerator capable of making ice particles in accordance with an embodiment of the present invention.

Referring to FIG. 2, a refrigerator of the present invention may include a body 200 having a storage space, a door (not shown) coupled with the body and used for opening/closing the storage space, and an ice particle maker 230 provided in the door. In addition, the ice particle maker 230 may include a water feed nozzle 214 for injecting the water supplied from a water supply source into an ice particle marking area 232, a cold air flow path 218 for supplying cold air to the ice particle making area 232, and a dispenser 240 for dispensing the ice particles made from the ice particle maker 230.

The ice particle maker 230 may further include a water supply unit 210, a feed pipe 212, a heater 216, an ice particle fan 222, a cold air supply unit 224, and a guide 226 as additional components.

In the example shown in FIG. 2, the ice particle maker 230 is installed in the refrigerator door, and a process of making ice particles is carried out by using cold air created by a freezing cycle of the refrigerator. However, the foregoing discussion is not limited thereto. That is, the aforementioned ice particle maker 230 may be installed in a water purifier with a freezer system, and may be implemented as an independent device.

Referring to FIG. 2, the water supply unit 210 is a device for supplying water (e.g., drinking water) to the ice particle making area 232. The water supply unit 210 may purify and supply the water taken in through a water supply source, for example, a water main pipe, or it may be supplied with purified water in advance which it stores and then supplies to the ice particle making area 232, but the present invention is not limited thereto.

The feed pipe 212 refers to a passage connected between the water supply unit 210 and the water feed nozzle 214 for delivering water. The feed pipe 212 enables the supplied water to move to the water feed nozzle 214 when the water is supplied from the water supply unit 210 in accordance with (in response to) a request for drinking water or ice particles.

The water feed nozzle 214 may be a pipe for discharging water supplied from the water supply unit 210 in the ice particle maker 230 implemented in a refrigerator. The water feed nozzle 214 may have a smaller diameter than the feed pipe 212 to allow the water supplied from the feed pipe 212 to be ejected from the water feed nozzle 214 as particles of a predetermined size. According to an embodiment, the predetermined size may be pre-calculated and established as a size that allows rapid freezing of water by cold air injected from the cold air flow path 218, into relatively fine ice particles having a diameter not greater than a reference diameter established in advance; however, the invention is not limited thereto.

In an embodiment, to implement the water feed nozzle 214, a plurality of water feed nozzles, each having a different diameter, may be provided to allow one water feed nozzle selected in response to a user input to be connected with the feed pipe 212, so that the size (e.g., diameter, volume) of the ejected water can be adjusted and the size of the ice particles can thereby be changed. In addition, the water feed nozzle 214 may have a diaphragm (not shown) for changing the diameter of the water feed nozzle 214 at the end of the water feed nozzle 214 in order to adjust the size (e.g., diameter, volume) of the ejected water by adjustment of the diaphragm.

As shown in FIG. 2, the heater 216 may be installed at the end of the water feed nozzle 214 to generate heat when driven by supplying power thereto, for heating the water feed nozzle 214 to thaw the water feed nozzle. The heater 216 may be driven for a predetermined period of time before water is supplied to the feed pipe 212, for example, when the ice particle maker 230 receives a request for drinking water or ice particles, to heat the water feed nozzle 214 in order to thaw the water feed nozzle 214 in advance of its use. In addition, the heater 216 may be implemented by winding a heating coil round the water feed nozzle 214 to generate heat in the heating coil when power is applied thereto, but the invention is not limited thereto.

The cold air flow path 218 is a path over which cold air for phase change of the water ejected from the water feed nozzle 214, for example, for making ice particles, is supplied, and the outlet 219 of the cold air flow path 218 from which cold air is discharged may be installed to face the end of the water feed nozzle 214. In this case, the cold air discharged from the cold air flow path 218 may be implemented so that the cold air generated in the freezing cycle of the refrigerator body may be supplied to the cold air flow path 218 through a duct 220, but the invention is not limited thereto. Moreover, an ice particle fan 222 may be installed at the rear end of the cold air flow path 218 (at the end facing the end of the water feed nozzle 214) to facilitate the flow of cold air so that the cold air flows fast through the cold air flow path 218. The ice particle fan 222 may be implemented to operate when the outlet 219 of the cold air flow path 218 is open, but the invention is not limited thereto.

The cold air supply unit 224 is installed in the outlet 219 of the cold air flow path 218 to open or close the outlet 219 in order to inject or interrupt (block) the flow of cold air from the cold air flow path 218 into the water feed nozzle 214. The aforementioned cold air supply unit 224 may be implemented as an electric damper, but the invention is not limited thereto.

That is, for example, when water is supplied to the feed pipe 212 in response to a user's request for ice particles, the water supplied as such may be ejected through the water feed nozzle 214. In this case, the cold air supply unit 224 may open the outlet 219 of the cold air flow path 218 to enable the cold air discharged from the cold air flow path 218 to be injected toward the water ejected from the water feed nozzle 214. As a result, the water ejected from the water feed nozzle 214 is subjected to a process for making ice particles, for example, by being cooled rapidly by the cold air injected from the cold air flow path 218 to be frozen into relatively fine ice particles (e.g., of a snow type). The process of making ice particles may refer to the process of freezing water having a diameter not greater than a predetermined reference diameter into fine ice particles (e.g., of a snow type), in comparison with ice having a relatively large diameter made by freezing water as in a conventional automatic ice maker. The reference diameter may be changed depending on the user's selection as mentioned above, but the invention is not limited thereto.

The cold air supply unit 224 closes the outlet of the cold air flow path 218 to interrupt cold air from being discharged from the cold air flow path 218 when the process of making ice particles is completed or when water is not being supplied from the feed pipe 212.

The guide 226 may be installed a predetermined distance below the water feed nozzle 214 to gather the fine ice particles made by the process of rapidly cooling and freezing water by means of cold air, and drop those ice particles into a predetermined area (e.g., into a cup). The guide 226 may be implemented as, for example, a cone with an inlet having a diameter that is relatively wide and an outlet having a diameter that is relatively narrow, but the invention is not limited thereto. Therefore, by using the guide 226, the fine ice particles made as described above may be put in a container (e.g., a cup) without scattering them when the container is placed below the guide 226.

Figure 3:
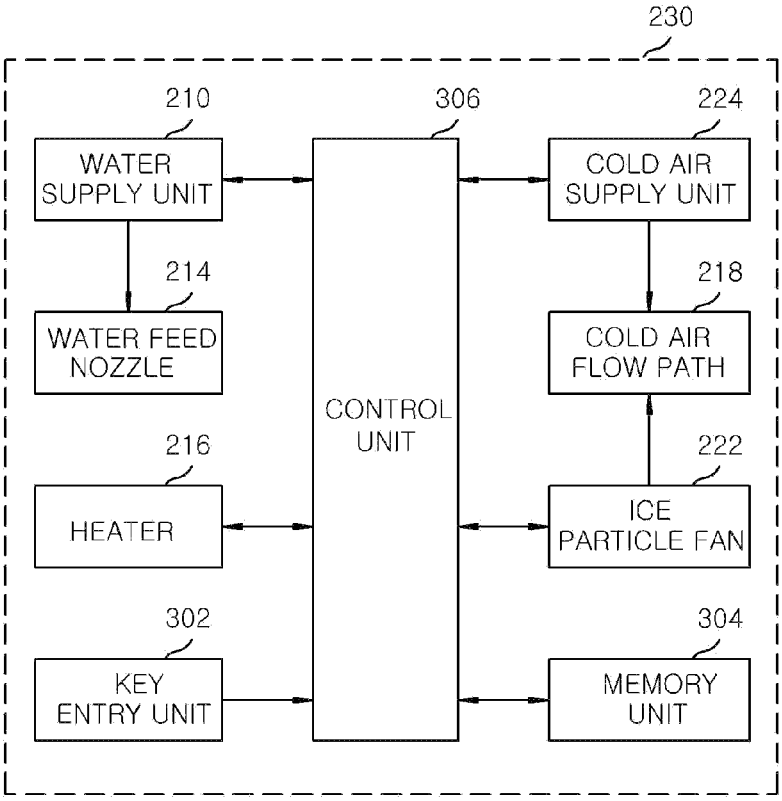
FIG. 3 shows a detailed block diagram of an ice particle maker in accordance with an embodiment of the present invention.

FIG. 3 shows a block diagram of the ice particle maker 230 in accordance with an embodiment of the present invention. The ice particle maker 230 may include a key entry unit 302, a water supply unit 210, a heater 216, a cold air supply unit 224, an ice particle fan 222, a memory unit 304, and a control unit 306.

Each component of the ice particle maker 230 in accordance with an embodiment of the present invention will be described hereinafter in detail with reference to FIG. 3.

The key entry unit 302 may be configured to have a plurality of numeral keys or function keys. When a user presses a given key, the key entry unit produces corresponding key data and outputs the data to the control unit 306. In addition, the plurality of numeral keys or function keys equipped in the key entry unit 302 may be implemented as a touch screen and software in place of a physical keypad.

The water supply unit 210 is a device for supplying water (e.g., drinking water) for the ice particle maker 230. The water supply unit 210 may purify and supply water introduced through a water main pipe, or it may be supplied with purified water in advance that it stores and then supplies to the ice particle making area 232. The water supply unit 210 may be driven under the control of the control unit 306 to supply a predetermined amount of water in response to the user's request for drinking water or for ice particles, the request made through the key entry unit 302.

When the predetermined amount of water is supplied from the water supply unit 210, the water is supplied to the feed pipe 212 connected with the dispenser 240 of the ice particle maker 230 to be sent to the water feed nozzle 214 where the water is finally discharged. In addition, the water feed nozzle 214 may refer to a pipe where water is finally discharged from the ice particle maker 230, has a smaller diameter than the diameter of the feed pipe 212, and has at least one small opening for ejecting water. As a result, the water supplied from the feed pipe 212 may be ejected as particles of a predetermined and relatively small size corresponding to the desired size of the ice particles.

The heater 216 is driven under the control of the control unit 306 to heat and thus thaw the water feed nozzle 214. The heater 216 may be installed at the end of the water feed nozzle 214 as shown in FIG. 2, and may generate heat if driven to thaw the water feed nozzle 214.

The cold air supply unit 224 may be installed in the outlet 219 of the cold air flow path 218, and opens or closes the outlet 219 of the cold air flow path 218. As a result, the cold air discharged from the cold air flow path 218 may be ejected in the direction of water feed nozzle 214 or it may be interrupted (blocked).

The control unit 306 controls overall operation of the ice particle maker 230 of the present invention in accordance with an operation program stored in the memory unit 304. In addition, the control unit 306 controls the water supply unit 210 to eject water from the water feed nozzle 214 when receiving a user's request for ice particles through the key entry unit 302, and controls the cold air supply unit 224 to open the outlet 219 of the cold air flow path 218. Opening the outlet 219 contributes to ejecting cold air toward the end of the water feed nozzle 214 to rapidly cool the water ejected from the water feed nozzle 214 by the cold air and thus make ice particles.

In order to make ice particles to address a request for ice particles, the control unit 306 controls the water supply unit 210 to drive the heater 216 installed at the end of the water feed nozzle 214 for a predetermined period of time before the water is ejected into the water feed nozzle 214 when a request for ice particles is received, to thaw the water feed nozzle 214. In addition, the control unit 306 may control the cold air supply unit 224 to drive the ice particle fan 222 for rapidly ejecting the cold air present in the cold air flow path 218 through the outlet 219 of the cold air flow path 218 at the time it opens the outlet 219 of the cold air flow path 218.

In addition, making ice particles may refer to the process of freezing water into fine ice particles (e.g., of a snow type) of which the diameter is not greater than a predetermined reference diameter, in comparison with freezing water into ice flakes having a relatively large diameter as in a conventional automatic ice maker. The range of the aforementioned reference diameter may change depending on a user's selection as described above.

That is, when the control unit 306 receives a request for ice particles, it carries out the process of making ice particles by recognizing the request for ice particles is for freezing the drinking water supplied from the water supply unit 210 into ice particles, and injecting cold air through the cold air flow path 218 into the water ejected from the water feed nozzle 214 to make relatively fine ice particles of which the diameter is not greater than a predetermined diameter.

Meanwhile, the user may make a request for general drinking water, not for ice particles, through the ice particle maker 230. In this case, the control unit 306 may control just the water supply unit 210 to supply a predetermined amount of water while the outlet 219 of the cold air flow path 218 is closed by controlling the cold air supply unit 224. In addition, when the control unit 306 completes the process of making ice particles to address a user's request for ice particles, it may control the cold air supply unit 224 to close the outlet 219 of the cold air flow path 218. This process contributes to avoiding unnecessarily injecting cold air from the cold air flow path 218 into the water feed nozzle 214.

Figure 4:
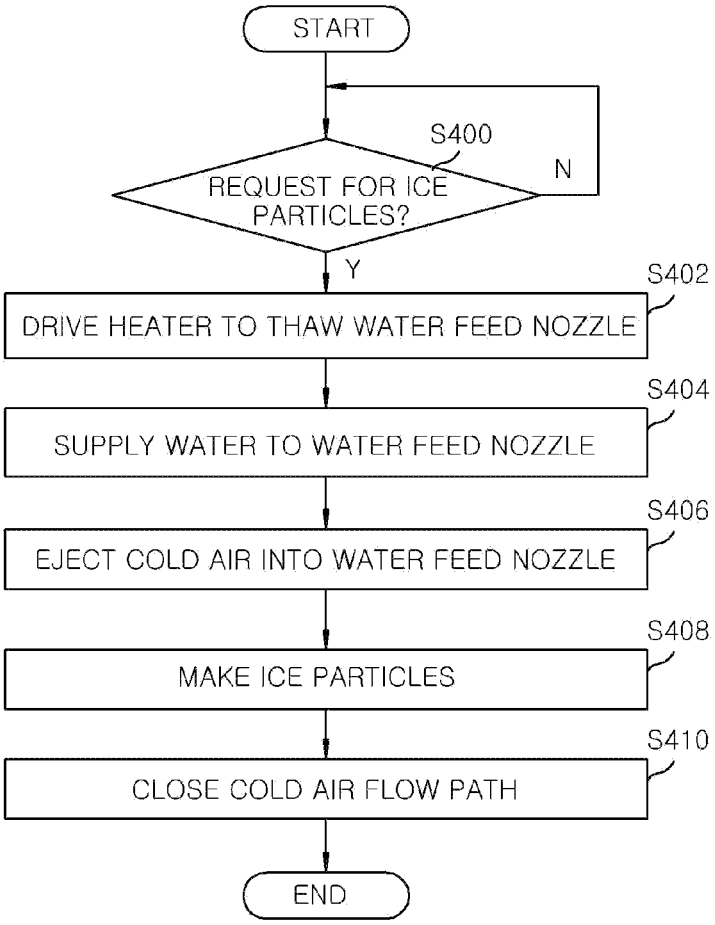
FIG. 4 shows a flow diagram for making ice particles with water in a refrigerator in accordance with an embodiment of the present invention.

FIG. 4 shows a flow diagram for making ice particles with water in a refrigerator having the ice particle maker 230 in accordance with an embodiment of the present invention. The embodiment of the present invention is described hereinafter in detail with reference to FIGS. 2 to 4.

The user may carry out a key operation to request that the ice particle maker 230 installed in a refrigerator make ice particles at S400. In this case, the request for ice particles may refer to a request for freezing drinking water into fine ice particles (e.g., of a snow type) of which the diameter is not greater than a predetermined reference diameter, in a dispenser of the refrigerator.

Subsequently, the control unit 306 of the ice particle maker 230 drives the heater 216 installed at a part of the end of the water feed nozzle 214 for a given predetermined period of time to thaw the water feed nozzle 214 when it receives the user's request for ice particles through the key entry unit 302 at S402. In this case, for example, the water feed nozzle 214 may have been frozen by the cold air after a repeated process of making ice particles carried out before the current request. In this case, water may not be ejected through the water feed nozzle 214. To avoid this issue in advance, the control unit 306 may drive the heater 216 before making ice particles to thaw the water feed nozzle 214.

Next, after thawing the water feed nozzle 214 by driving the heater 216, the control unit 306 may control the water supply unit 210 so that a predetermined amount of water for making ice particles may be supplied to the water feed nozzle 214 at S404.

Thereafter, the control unit 306 controls the cold air supply unit 224 for making ice particles with the water ejected from the water feed nozzle 214 to open the outlet 219 of the cold air flow path 218 so that cold air from the cold air flow path 218 may be ejected from the outlet 219 (and injected into the water ejected from the water feed nozzle 214) at S406. The water ejected from the water feed nozzle 214 is thus rapidly cooled to be made into ice particles at S408.

In this case, the control unit 306 may control the cold air to be injected into the end of the water feed nozzle 214 at the time when the water is ejected from the water feed nozzle 214 or before ejecting the water in order, but the invention is not limited thereto. In addition and in this case, the control unit 306 may control the cold air supply unit 224 to drive the ice particle fan 222 so that the cold air present in the cold air flow path 218 may be rapidly ejected through the outlet 219 of the cold air flow path 218 at the time when it opens the outlet 219 of the cold air flow path 218.

The cold air ejected through the cold air flow path 218 enables the water to be made into ice particles at the time when the water is ejected from the water feed nozzle 214. The water ejected from the water feed nozzle 214 is made into fine ice particles of, for example, a snow type, which drop and are gathered through the guide 226 to be put into a container, for example, a cup placed by a user.

Subsequently, when the aforementioned process of making ice particles with water is completed, the control unit 306 controls the cold air supply unit 224 to close the outlet 219 of the cold air flow path 218 at S410 so that the cold air from the cold air flow path 218 is not unnecessarily injected into the water feed nozzle 214.

As described above, in accordance with the present invention for a refrigerator capable of making ice particles, it is possible to provide relatively fine ice particles of, for example, a snow type by ejecting supplied water through a water feed nozzle formed with a relatively narrow pipe having a predetermined diameter and rapidly cooling the water ejected from the water feed nozzle by injecting cold air into the water. In addition, it is not necessary to use expensive and complex equipment for making fine ice particles, for example, an ice crushing device, resulting in cost savings, and also enhancing durability and reducing noise.

While the description of the present invention has been made to the example embodiments, various changes and modifications may be made without departing from the scope of the present invention. The embodiments of the present invention are not limited thereto. Therefore, the scope of the present invention should be defined by the appended claims rather than by the foregoing embodiments.

What is claimed is:

1. A refrigerator, comprising:

a body having a storage space;

a door coupled with the body and operable for opening/closing the storage space, and an ice particle maker equipped in the door;

wherein the ice particle maker comprises:

a water feed nozzle configured to eject water supplied from a water supply source into an ice particle making area;

a cold air flow path configured to supply cold air to the ice particle making area; and a dispenser operable for discharging ice particles made from the ice particle maker, wherein the water feed nozzle has a diameter smaller than a feed pipe that supplies the water from the water supply source, and wherein the water feed nozzle ejects the water supplied from the feed pipe as particles of a predetermined size.

2. The refrigerator of claim 1, further comprising a heater operable for heating the water feed nozzle.

3. The refrigerator of claim 2, wherein the heater is installed at the end of the water feed nozzle, and is driven at a time selected from the group consisting of: when the water is supplied from the water supply source, and for a predetermined period of time before the water is supplied from the water supply source.

4. The refrigerator of claim 1, further comprising a cold air supply unit installed in the outlet of the cold air flow path and operable for opening and closing the outlet.

5. The refrigerator of claim 4, wherein the cold air supply unit opens the outlet of the cold air flow path and injects the cold air into the water feed nozzle when the water is being supplied from the water supply source, and closes the outlet of the cold air flow path when the water is not being supplied.

6. The refrigerator of claim 1, wherein the predetermined size allows the particles to be rapidly frozen by the cold air into ice particles having a diameter not greater than a predetermined reference diameter.

7. The refrigerator of claim 1, wherein the water feed nozzle is selected from a plurality of water feed nozzles individually connectable with the feed pipe, each of the water feed nozzles in the plurality having a different diameter.

8. The refrigerator of claim 1, wherein the water feed nozzle comprises a diaphragm operable for changing the diameter of the water feed nozzle at the end of the water feed nozzle to control the size of water particles ejected by controlling the diaphragm.

9. The refrigerator of claim 1, wherein the water feed nozzle comprises a guide that is installed at the lower end thereof and is configured to gather the ice particles and drops the ice particles into a predetermined area, the guide having a diameter not greater than a predetermined reference diameter.

10. The refrigerator of claim 1, wherein the cold air flow path comprises an ice particle fan installed at the rear end of the cold air flow path and configured to move the cold air supplied to the cold air flow path toward the outlet.

11. A method for making ice particles, the method comprising:

controlling a water supply source to supply water to a water feed nozzle connected with the water supply source when a request for ice particles is received; and controlling a cold air supply unit installed in the outlet of a cold air flow path to inject cold air from the cold air flow path into the water feed nozzle when the water is supplied from the water supply source;

wherein the ice particles are made by injecting the cold air and freezing the water ejected from the water feed nozzle, the ice particles having a diameter not greater than a predetermined diameter, wherein the water feed nozzle has a diameter smaller than a feed pipe that supplies the water from the water supply source, and wherein the water feed nozzle ejects the water supplied from the feed pipe as particles of a predetermined size.

12. The method of claim 11, further comprising:

in response to the request for a process of making ice particles, driving a heater installed at the water feed nozzle for a predetermined period of time before the water is supplied.

13. The method of claim 11, further comprising:

after performing a process of making ice particles, interrupting the water supply and controlling the cold air supply unit to close the outlet of the cold air flow path.

14. The method of claim 11, wherein the water feed nozzle, the cold air flow path, and a dispenser operable for discharging the ice particles are in a door of a refrigerator comprising a body having a storage space, wherein the door is operable for opening/closing the storage space.

* * * * *